United States Patent [19]

Kreeger

[11] Patent Number: 4,842,142

[45] Date of Patent: Jun. 27, 1989

[54] OPEN-FRONT, TWO-LEVEL STACKING CONTAINER

[75] Inventor: Elsmer W. Kreeger, Howell, Mich.

[73] Assignee: Pinckney Molded Plastics, Inc., Howell, Mich.

[21] Appl. No.: 135,589

[22] Filed: Dec. 21, 1987

[51] Int. Cl.[4] ..... B65D 21/00

[52] U.S. Cl. ..... 206/505; 206/506

[58] Field of Search ..... 206/503, 505, 506, 509, 206/511

[56] References Cited

U.S. PATENT DOCUMENTS

| | | | |
|---|---|---|---|
| 4,000,817 | 1/1977 | Sanders et al. | 206/505 |
| 4,007,839 | 2/1977 | Stahl | 206/503 |
| 4,211,327 | 7/1980 | Stahl et al. | 206/505 |
| 4,383,611 | 5/1983 | Kreeger | 206/505 |
| 4,577,759 | 3/1986 | Kreeger | 206/505 |
| 4,600,103 | 7/1986 | Tabler | 206/505 |

*Primary Examiner*—Joseph Man-Fu Moy

*Attorney, Agent, or Firm*—Basile and Hanlon

[57] ABSTRACT

An open-front, two-level stacking container which may incorporate a tray removable through the open front of a stacked container is provided with a web and slot interlocking arrangement for positively interlocking two stacked containers against front-rear movement relative to each other. Transverse webs in recesses in the stacking feet of one container are received in locking slots in the support shelves of the underlying container and so arranged that the upper container may be slid rearwardly of the lower container to a positively interlocked upper or lower stacked relationship.

13 Claims, 4 Drawing Sheets

OPEN-FRONT, TWO-LEVEL STACKING CONTAINER

BACKGROUND OF THE INVENTION

The present invention is concerned with a stacking container of the type typically employed in the delivery and handling of bakery products. Many examples of such containers are found in the prior art. The containers are so designed as to enable one container to be stably stacked on the top of a like container while maintaining an adequate clearance so that bakery products in the lower container are not crushed by the stacked container.

Typically, provisions are made for stacking containers at two or more levels relative to the underlying container so that stack height can be minimized where some of the containers container products, such as cupcakes, whose height is not as great as products, such as loaves of bread, contained in other containers. It is also known in this art to employed so-called open-front containers in which the product in any container in the stack can be identified from the front of the stack since at least a portion of the product is visible through the open front. It is also known in the art to provide such open-front containers with removable trays which can be withdrawn through the open front of the container to afford access to products in the container without unstacking the overlying containers.

This latter arrangement is particularly convenient for delivery men in restocking supermarket shelves. The delivery man assembles upon a cart a stack of containers holding the desired selection of products and by drawing out or removing the trays is able to restock the store shelves with a variety of products while the containers themselves remain in the originally assembled stack. Unless during withdrawing and replacement of the tray a reasonable degree of care is taken, the tray may bind or hang up with its container, and thus in containers of this type it is essential that the stacked containers be interlocked with each other in a manner such that relative horizontal movement between the stacked containers, particularly, in the front/rear direction, be minimized in order to maintain stability of the stack. In that stacking of the containers, particularly in low-stack relationship to each other, typically involves a sliding movement of the upper container rearwardly relative to the underlying container, the provision of an arrangement for interlocking the containers against front-to-rear relative movement which also accommodates a smooth-sliding movement to the stacked position as well as disengagement upon unstacking presents a problem.

The present invention is directed to a solution of that problem.

SUMMARY OF THE INVENTION

In accordance with the present invention, a two-level, open-front container is formed with a plurality of stacking feet which project outwardly from the opposed side walls of the container at spaced locations along the lower edge of the side wall. Corresponding upper support shelves are formed at correspondingly spaced locations along the upper edge of each side wall to receive and support the stacking feet of a like container to stack the like container upon the first in a high-stacked position. A low-stacked position is achieved by forming on the inner side of each of the opposed side walls a set of lower support shelves spaced vertically below the corresponding upper shelves. To position the like container in a low-stacked position, the stacking feet of the like container are lowered downwardly through openings in the opposed side walls of the underlying container which are located forwardly of each of the upper support shelves. At the lower end of these access openings, an undercut opening extends rearwardly beneath the associated upper shelf. The lower edge of all but the forwardmost access openings is formed with a downwardly and rearwardly inclined shelf which engages and guides the corresponding stacking feet of the like container downwardly and rearwardly onto the associated lower support shelf.

The upper sides of the various support shelves are formed with recesses of U-shaped cross section whose outer side is formed by the side wall of the container and whose inner side is formed with a vertically disposed web. The stacking feet are formed with complementary recesses on their bottoms of inverted U-shaped cross section whose inner wall is formed by the side wall of the container and whose outer wall is formed with a vertically downwardly projecting web. When in a stacked relationship, either upper or lower, the vertical webs of the shelves project upwardly into the recesses of the stacking feet, and this relationship satisfactorily interlocks the stacked containers against side-to-side movement relative to each other.

To prevent relative front-rear movement of containers stacked in high-stacked relationship to each other, the vertical web of the rearwardmost upper shelf is formed with a vertical slot which extends downwardly from the upper edge of the web. A vertical locking web is formed in the rearwardmost stacking foot to extend transversely across the recess in the stacking foot in alignment with the last-mentioned slot. When one container is seated in a high-stacked position upon a like container, the locking webs in the rearwardmost stacking feet of the upper container are seated in the vertical slots in the webs of the rearwardmost upper shelves to interlock the two containers against any forward or rearward movement relative to one another.

To interlock two containers against forward or rearward movement relative to one another when in the low-stacked position, an abutment is formed at the forward end of each forwardmost lower shelf to project from the outer wall of the recess transversely across approximately one-half of the width of the recess. The rearward edge of the abutment is a vertical surface perpendicular to the outer wall and extending upwardly from the bottom of the recess. The vertical web at the inner side of the recess in the forwardmost lower shelf is formed with a vertical front edge spaced rearwardly from the rear edge on the abutment. This spacing constitutes the rear edge of the abutment and the front edge of the web respectively as the front and rear walls of a vertical slot. A transverse locking web is formed in the recess of the forwardmost stacking foot in vertical alignment with this slot. The upper surface of the abutment is inclined downwardly and rearwardly to the top of the rear edge of the abutment to guide the web into the slot as the upper of two containers is moved rearwardly and downwardly into the low-stacked position. The side wall of the container is formed with a recess in front of the forward stacking foot which will accommodate the abutment of a like container when the two containers are in the low-stacked position.

Other objects and features of the invention will become apparent by reference to the following specification and to the drawings.

DESCRIPTION OF THE PREFERRED EMBODIMENT

Figure 1:
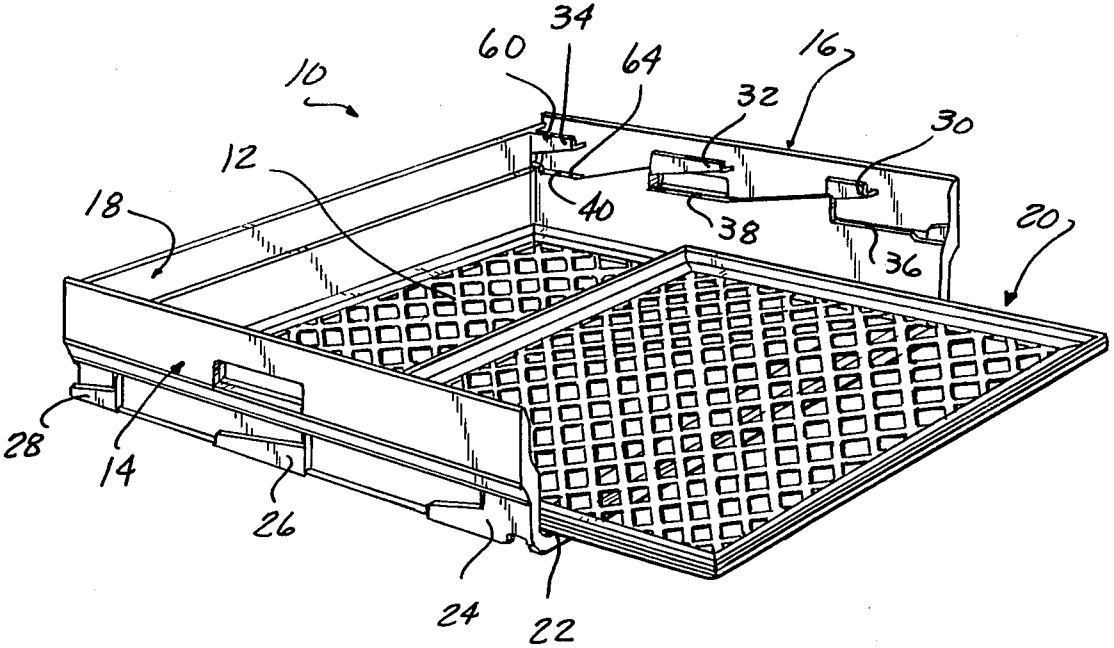
FIG. 1 is a perspective view of a container embodying the present invention.
Figure 2:
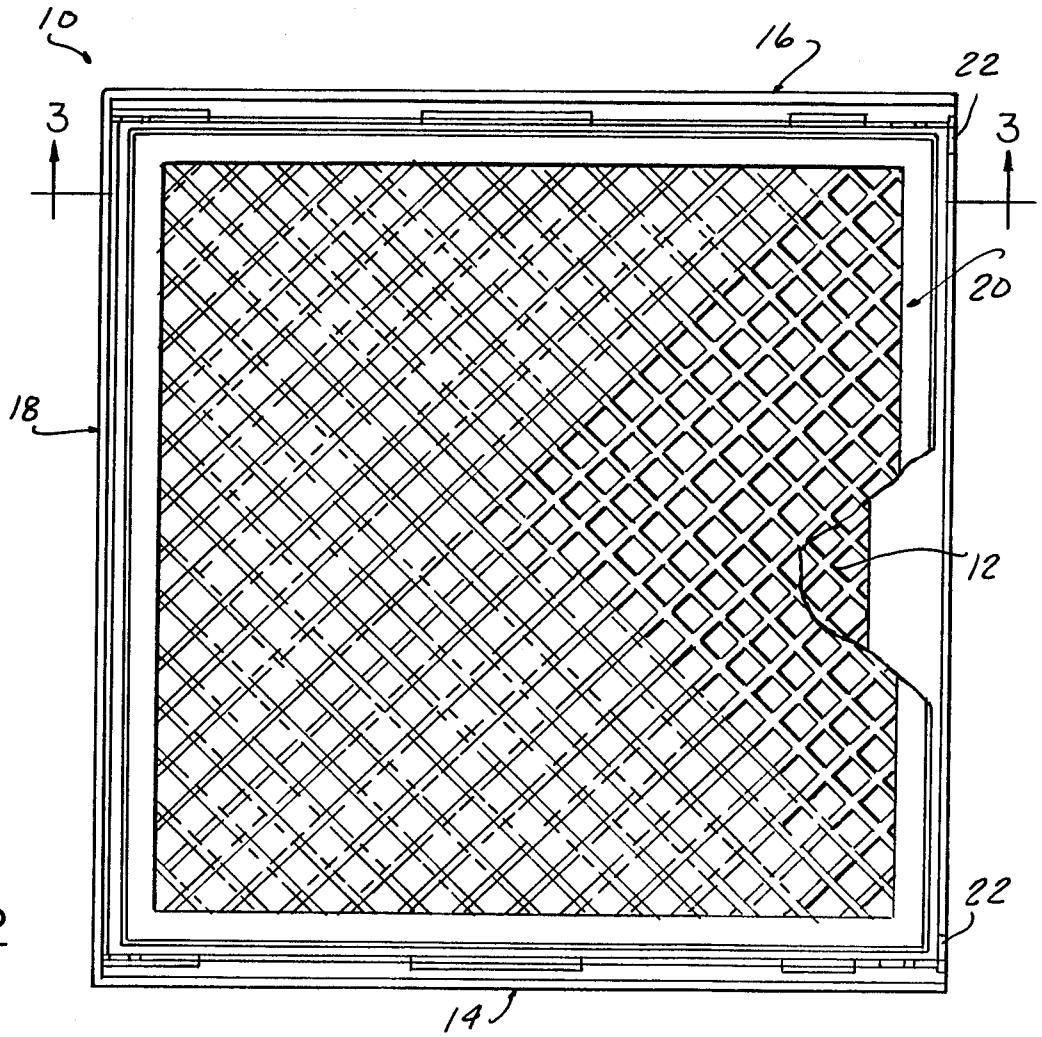
FIG. 2 is a top plan view of the container of FIG. 1 with certain portions broken away.

Referring first to FIG. 1, an open-front, two-level stacking container embodying the present invention is designated generally 10 and includes a rectangular bottom 12, which may be formed as an open grid work for weight reduction purposes, a pair of opposed side walls 14, 16 and a rear wall 18. As is typical in this art, the container 10 may be of one-piece, molded construction formed of a suitable thermoplastic material, such as polyethylene or polypropylene. A rectangular tray 20, similarly formed of a like thermoplastic material, is slidably received between side walls 14 and 16 to be supported upon bottom 12, the tray 20 being shown partially withdrawn in FIG. 1. When tray 20 is fully inserted into container 10, see FIG. 2, the forward corners of the tray drop downwardly behind gussets 22 at the lower end of each side wall, the gussets retaining the tray in position until the forward end of the tray is manually lifted so that its front corners will clear gussets 22.

Side walls 14 and 16 are identical with the exception of being left- and right-handed versions of each other. Because of this identity, the same reference numerals will be employed to describe the corresponding structural features on walls 14 and 16.

Figure 3:
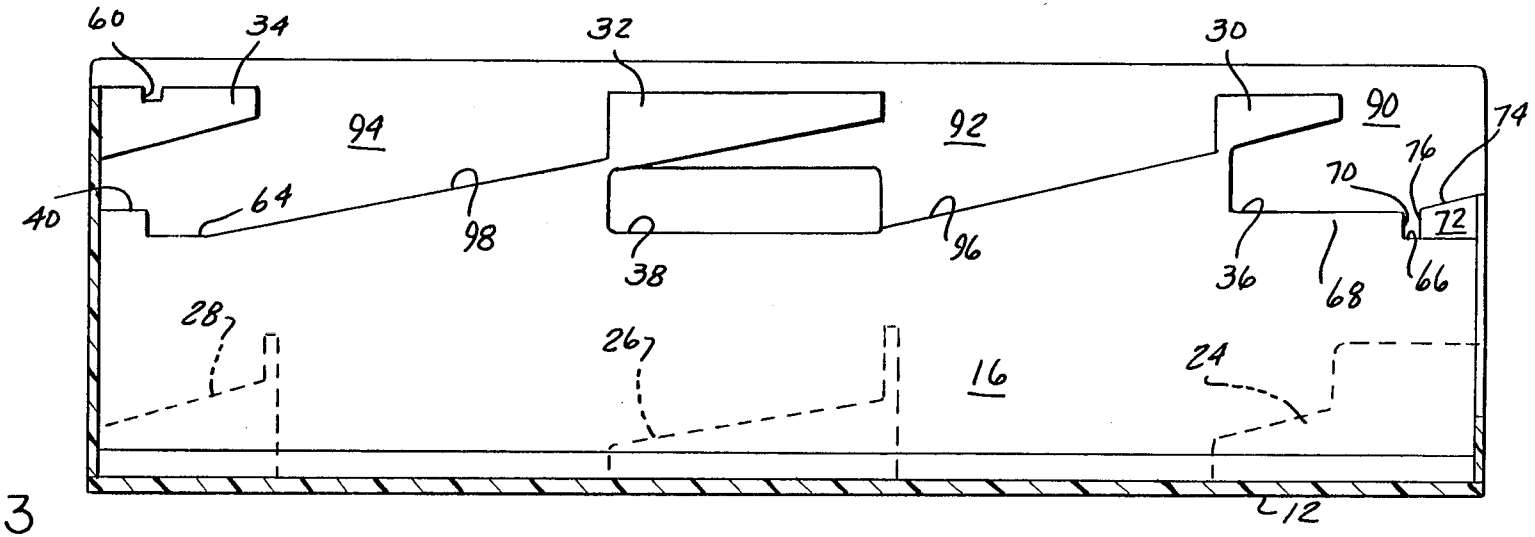
FIG. 3 is a cross-sectional view taken approximately on the line 3—3 of FIG. 2, with certain parts omitted.
Figure 4:
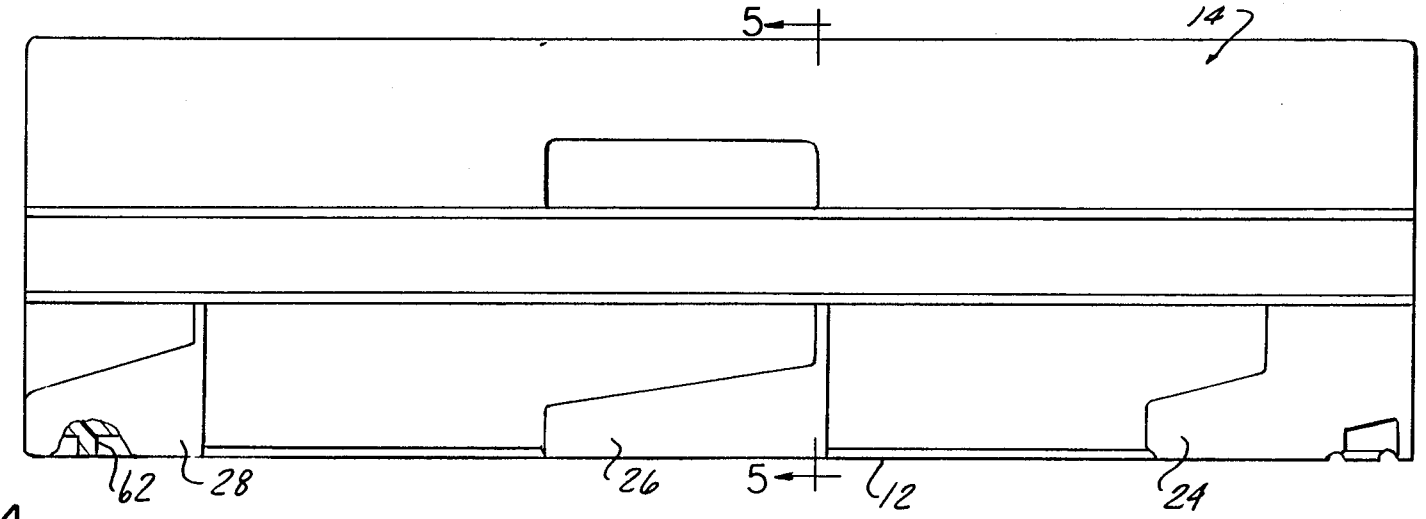
FIG. 4 is a side elevational view of the container of FIG. 1 with a portion of the rear stacking foot broken away and shown in section.

Referring now particularly to FIGS. 1, 3 and 4, each side wall is formed with three stacking feet 24, 26 and 28 which project outwardly from the outer side of the side wall at spaced locations along its lower edge. Correspondingly spaced, upper support shelves 30, 32 and 34 are formed on the inner side of each side wall closely adjacent the upper edge of the wall. A series of lower support shelves 36, 38 and 40 are also formed at the inner side of each side wall in spaced, vertical, underlying relationship to the respective upper shelves 30, 32 and 34.

Figure 5:
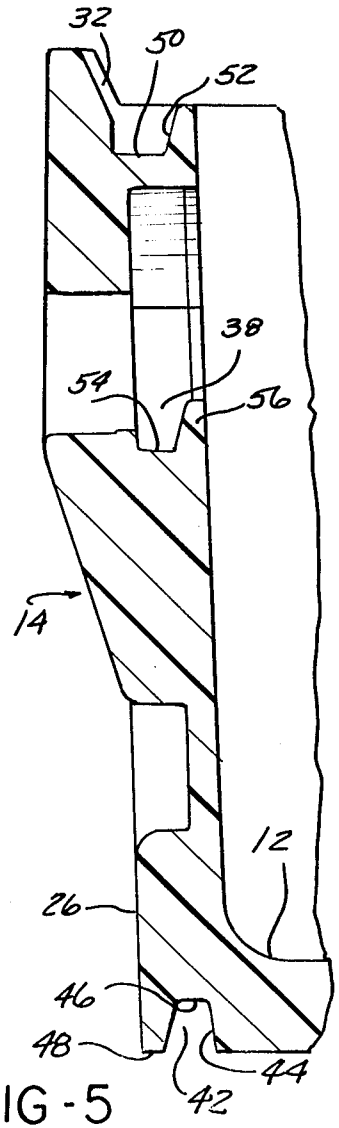
FIG. 5 is a cross-sectional view taken approximately on the line 5—5 of FIG. 4.

Referring now to the cross-sectional view of FIG. 5, it is seen that the stacking feet, such as foot 26, are formed with a downwardly opening recess 42 which extends lengthwise of the bottom of the stacking foot. Recesses 42 are of a generally inverted, U-shaped, transverse cross section with the inner wall being defined by the outer side surface 44 of the lower end of the side wall, a horizontal upper surface 46 and a downwardly projecting, vertical web 48 which defines the outer side of recess 42. Recess 42 extends the entire length of stacking foot 26, and similar recesses are formed in the underside of stacking feet 24 and 28.

As shown in FIG. 5, upper shelf 32 is formed with an upwardly facing support surface 50 at the inner side of the side wall and an upwardly projecting vertical web 52 extending along the inner side of surface 50 to again define an upwardly opening recess of U-shaped, transverse cross section which extends from one end of the shelf to the other. The corresponding lower support shelf 38 is of similar cross-sectional configuration, having an upwardly facing horizontal support surface 54 at the inner side of side wall 14 and a vertical web 56 extending along the inner side of surface 54. The side walls are each inclined upwardly and somewhat outwardly from bottom 12 so that the recess 42 in stacking foot 26 is vertically aligned with web 52 of the upper shelf 32 and web 56 of the corresponding lower shelf 36. This arrangement is quite similar to that disclosed in my earlier issued Patent U.S. Pat. No. 4,577,759. The cross-sectional configurations of shelves 30, 34, 36 and 40 corresponding to those of shelves 32 and 36. As is believed apparent from my aformentioned Patent U.S. Pat. No. 4,577,759, two like containers embodying the present invention may be stacked one upon the other in a high-stacked position by seating the stacking feet 24, 26 and 28 of the upper container upon the upper shelves 30, 32 and 34 of the underlying container; or, alternatively, the two like containers may be stacked one upon the other in a low-stacked position in which the stacking feet 24, 26, and 28 of the upper container are supported upon the lower shelves 36, 38 and 40 of the underlying container. The vertical spacing of the upper and lower shelves from the container bottom is selected in accordance with the particular products to be carried in the containers. In the containers of the present application, the height of the upper shelf above the bottom for one commercially used model of the container is six inches, while the height of the lower shelf is four inches above the bottom. In the high-stacked position, adequate clearance is provided for loaves of bread in the lower container, while in the low-stacked position adequate clearance is present to permit packages of donuts, rolls, etc. to be carried in the lower container, trays 20 being employed in both instances.

When the stacking feet are supported upon either of the upper or lower shelves, the recess in the bottom of the stacking foot receives or straddles the vertical webs, such as 52 or 56, on the shelves. This engagement provides a satisfactory interlock of two stacked containers against horizontal side-to-side movement relative to one another.

To maintain two stacked containers against relative front-to-rear movement when stacked in the upper-stacked position, the vertical web of the rearwardmost stacking shelves 34 is formed with a vertical slot 60 (FIGS. 1 and 3) while the rearwardmost stacking feet 28 of the container are formed with vertically extending locking webs 62 (FIG. 4) which extend transversely across the recess in the bottom of stacking foot 28 in vertical alignment with the slot 60. When one container is stacked with its stacking feet supported by the upper shelves of the underlying container, the vertical webs 62 on the rearward stacking feet 28 are received within the slots 60 of the rearward upper support shelves 34.

This engagement interlocks the two containers against forward or rearward movement relative to each other. To unstack the containers, it is necessary to lift the upper container to disengage the webs 62 from slots 60.

Clearance for the locking webs 62 when the container is to be stacked in the low-stacked position is provided by cutting away the forward portion of the vertical inner web of the rearward lower stacking shelves as at 64 (FIGS. 1 and 3).

The structure for interlocking two containers against relative forward and rearward movement when in the low-stacked position is somewhat more complex and is best seen in FIGS. 6 through 9.

Figure 6:
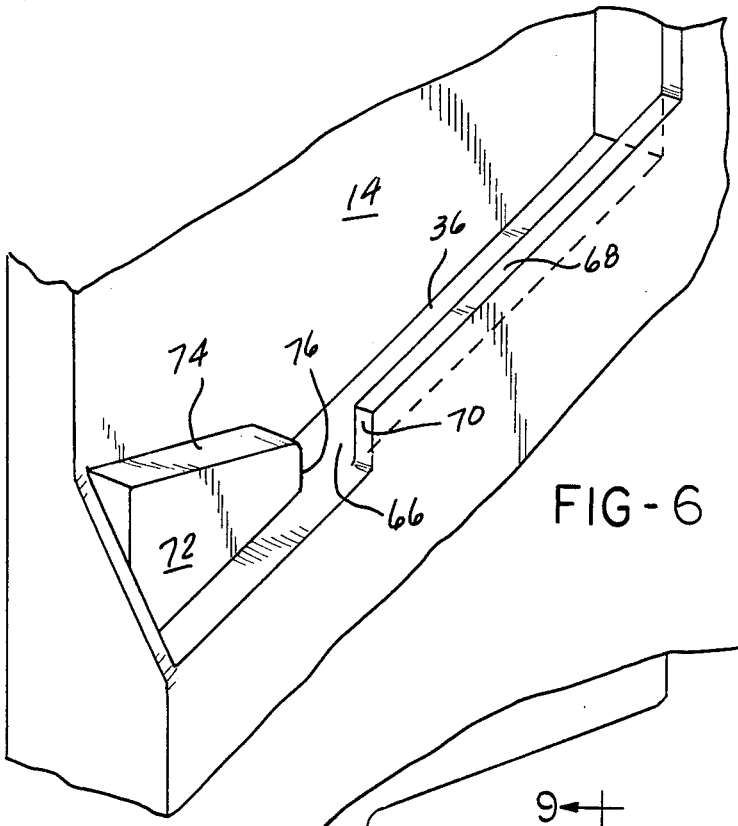
FIG. 6 is a partial, perspective view showing details of a forwardmost lower stacking shelf.
Figure 9:
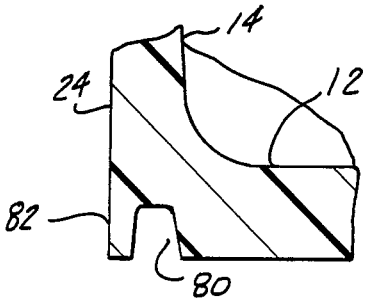
FIG. 9 is a cross-sectional view taken on the line 9—9 of FIG. 7.

Referring first to FIG. 9, it is seen that the front lower support shelf is formed with a horizontal, upwardly facing support surface 66 at the inner side of the side wall (14 as shown in FIG. 6) with a vertical web 68 projecting upwardly along the inner side of support surface 66. Web 68 terminates at a vertical front edge 70.

At the forward end of support surface 66, an abutment 72 is formed on side wall 14 to project inwardly partially across support surface 66. Abutment 72 is formed with a rearwardly and downwardly inclined upper surface 74 which terminates at its rearward end with a vertical rearward edge 76 extending downwardly from upper edge 74 to support surface 66. The rearward edge 76 of abutment 72 is spaced forwardly from edge 70, as best seen in FIG. 3, so that when viewed from the side, the edges 70 and 76 respectively define the front and rear walls of a vertical slot.

Figure 7:
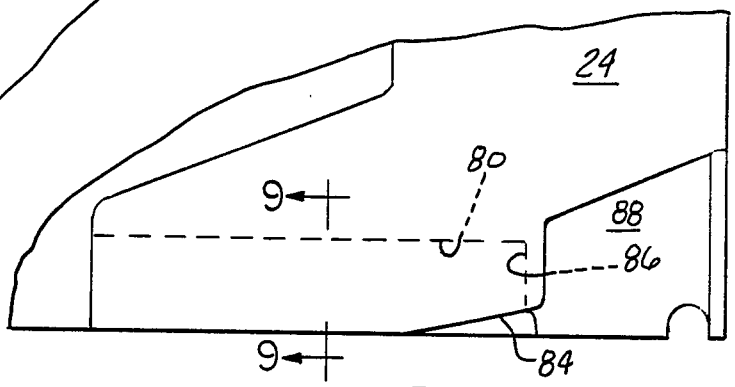
FIG. 7 is a detail, side elevational view of a forwardmost stacking foot.
Figure 8:
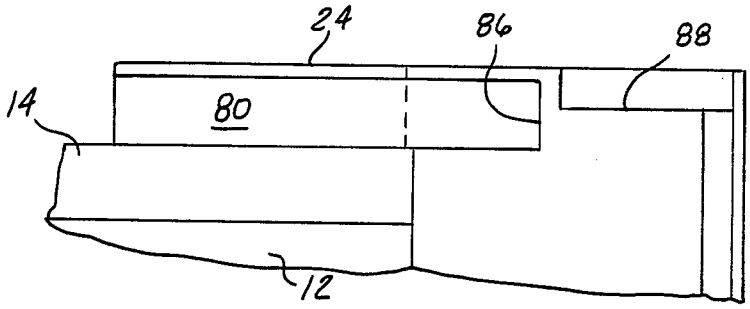
FIG. 8 is a bottom plan view of the stacking foot of FIG. 7.

Referring now to FIGS. 7 through 9, it is seen that the front stacking foot 24 is formed with a recess 80 on its underside which, as best seen in FIG. 9, is of a cross-sectional configuration similar to that of the recess 42 described above. The outer web 82 at the outer side of recess 80 is formed with a slightly upwardly inclined, forward lower edge section 84 (FIG. 7) and a vertical locking web 86 extends transversely across the forward end of recess 80. Forwardly of web 86, the outer side of stacking foot 24 is formed with a recess 88 conformed to receive the abutment 72 on a forward lower stacking shelf when the containers are stacked in their low-stacked position. At this time, the locking web 86 will traverse the slot defined by edges 70 and 76 associated with the forward stacking shelf to positively lock the two containers against forward or rearward movement relative to one another from the low-stacked position.

To stack one container upon another in the low-stacked position, the upper container is positioned above the lower container so that its stacking feet are respectively aligned with access openings forwardly of each of the upper shelves 30, 32 and 34, these access openings being indicated at 90, 92 and 94 in FIG. 3. The upper container is then lowered vertically downwardly so that the stacking feet pass downwardly through openings 90, 92 and 94 until the stacking feet 26 and 28 engage downwardly and rearwardly inclined sections 96 and 98 at the bottom of access openings 92 and 94. At this time, normally, the forward stacking feet 24 do not contact anything, since they will be somewhat forward of abutment 72. The upper container can then slide, either gravitationally or with some manual assistance, downwardly and rearwardly, guided by the engagement of inclined sections 96 and 98 with stacking feet 26 and 28, and eventually the locking webs 86 on the forward stacking feet 24 will engage the upper surface 74 of the abutment 72. As the upper container moves into its final low-stacked relationship with the lower container, locking web 86 will drop downwardly along rearward edge 76 of the abutment 72 to lock the two containers against forward or rearward movement relative to each other.

While one embodiment of the invention has been described in detail, it will be apparent to those skilled in the art the disclosed embodiment may be modified. Therefore, the foregoing description is to be considered exemplary rather than limiting, and the true scope of the invention is that defined by the following claims.

What is claimed is:

1. An open-top, open-front container comprising a rectangular bottom, opposed side walls and a rear wall projecting upwardly from the opposed side edges and the rear edge of said bottom, said side walls each comprising a main web, a plurality of stacking feet mounted on the outer side of said main web at spaced locations along the lower edge of said main web, a like plurality of horizontally aligned open upper support shelves located at spaced locations along the upper edge of said main web in respective vertical alignment with said stacking feet, a stacking foot receiving opening including an access opening extending downwardly into said main web forwardly of each of said upper support shelves and an undercut opening extending rearwardly from the access opening beneath each upper support shelf for essentially the entire length of the upper support shelf and terminates in a rearwardly-oriented bulkhead, means at the lower edge of each undercut opening defining a lower support shelf vertically aligned with and spaced below the overlying upper support shelf, a first locking slot extending vertically downwardly into the lower edge of the forwardmost access opening, a vertically extending first locking web on the bottom of the forwardmost stacking foot in vertical alignment with said locking slot, a second locking a slot extending vertically downwardly into the rearwardmost upper support shelf at an essentially central location therein, a vertically extending second locking web on the bottom of the rearwardmost stacking foot in vertical alignment with said second locking slot, the first locking webs of a first container being adapted to be received within the first locking slots of a second like container when the stacking feet of the first container are supported on the lower shelves of the second container to lock the first and second containers against forward and rearward displacement relative to each other, and the second locking webs of said first container being adapted to be received in the second locking slots of the second container when the stacking feet of the first container are supported on the upper shelves of said second container to lock said first and second containers against forward and rearward displacement relative to each other.

2. The invention defined in claim 1 wherein each stacking foot includes a horizontal, downwardly facing support surface on its underside and a vertical web projecting downwardly of th stacking foot along the outer edge of said downwardly facing support surface to define a recess of inverted U-shaped cross section on the underside of each stack foot extending the entire length of the stacking foot, and said shelves each include a horizontal, upwardly facing support surface and a vertical web projecting upwardly of said shelf along the inner edge of said upwardly facing support surface to define a recess of an open U-shaped cross section at the top of each shelf extending the entire length of the shelf, the vertical web vertically aligned with said recess in the associated stacking foot, the vertical webs of the stacking feet of said first container and the shelves of said second container respectively projecting into the recesses of the shelves of the second container and the stacking feet of said first container when the first container is stacked upon the second container, said second locking slot projecting through the vertical web of each rearwardmost upper shelf and said second locking web comprising a web extending transversely across the recess in each rearwardmost stacking foot.

3. The invention defined in claim 2 wherein at least the rearwardmost access opening in said main web is formed with an upwardly facing, downwardly and rearwardly inclined guide shelf merging at its rearward end with the forward end of the lower support shelf, the forward end of the vertical web of the rearwardmost lower support shelf being similarly downwardly and rearwardly inclined to the upwardly facing support surface to accommodate unrestricted movement of the second locking web of a like container to and from said rearwardmost lower support shelf.

4. The invention defined in claim 2 wherein said means defining said first locking slot comprises an abutment on said main web projecting inwardly from the outer side of the recess in the forwardmost lower support shelf partially transversely across the recess and having a vertical, rearwardly facing rear edge defining the forward wall of said first locking slot, the vertical web of said forwardmost lower support shelf having a vertical, forwardly facing front edge spaced rearwardly from said rear edge defining the rearward wall of said first locking slot.

5. The invention defined in claim 4 wherein said abutment includes an upper surface sloping downwardly and rearwardly from its front to said rear edge.

6. The invention defined in claim 1 wherein said lower shelves are spaced vertically below said upper shelves by a distance less than one-half the height of said upper shelves above said bottom.

7. The invention of claim 1 wherein the upper support shelves comprise an outwardly flared outer side, an upwardly facing support surface and an upwardly projecting vertical web extending from the upwardly facing support surface opposed to the outwardly flared outer side.

8. The invention of claim 4 wherein a recess is formed between the forwardmost stacking foot and the front of the container, the recess bounded by a front panel, a rearwardly and downwardly inclined upper panel attached to the front panel and the vertical locking web, the recess adapted to receive the abutment therein.

9. The invention of claim 8 wherein the recess is further defined by a forward lower front end which is rearwardly and downwardly inclined from the lower edge of the vertical locking web.

10. The invention of claim 3 wherein the rearwardly inclined section of the rearwardmost access opening terminates in a vertically facing support surface between the rearwardly inclined section and the upwardly projecting lower support shelf such that the vertically extending locking web of a second container contacts the lower support shelf in releasable abutting contact when the stacking feet of a second container is placed in contact with the lower support shelves of a first container.

11. An open-top, open-front container comprising a rectangular bottom, opposed side walls and a rear wall projecting upwardly from the opposed side edges and the rear edge of said bottom, the side walls each inclined outwardly and upwardly from the bottom, the side walls comprising:

a main web having an outer side;

a plurality of stacking feet mounted on the outer side of the main web at spaced locations along the main web's lower edge, each stacking foot having (a) a horizontally, downwardly facing support surface on its underside, (b) a vertical web projecting downwardly from the stacking foot along the outer edge of the downwardly facing support surface, and (c) an upwardly facing surface downwardly inclined toward said rear wall, each stacking foot having a U-shaped recess on its underside extending the entire length of the stacking foot;

a plurality of horizontally aligned upper support shelves located at spaced locations along the upper edge of the main web in respective vertical alignment with the stacking feet, the upper support shelves having a horizontal, upwardly facing support surface attached to the inner side of the main web and a vertical web attached to the support surface and projecting upwardly therefrom along an inner edge of the support to define a recess of U-shaped cross section at the top of each shelf extending the entire length of the shelf, the vertical web being vertically aligned with the recess in the associated stacking foot;

the main web having a stacking foot receiving opening including an access opening extending downward into the main web forwardly of the upper support shelves and an undercut opening extending rearwardly from the access opening beneath essentially the entire length of each upper support shelf;

lower support shelves located at the lower edge of each respective undercut opening, the lower support shelves vertically aligned with and spaced below the respective overlying upper support shelf;

a first locking slot extending vertically downward into the lower edge of the forwardmost access opening;

a vertically extending first locking web on the bottom of the forwardmost stacking foot in vertical alignment with the locking slot;

a second locking slot extending vertically downwardly into the rearwardmost upper support shelf;

a vertically extending second locking web on the bottom of the rearwardmost stacking foot in vertical alignment with the second locking slot;

wherein at least the forwardmost access opening in the main web includes an abutment located on the main web projecting inwardly from the outer side of the recess and having a vertical rearwardly facing rear edge defining the forward wall of the first locking slot, the vertical web of the forwardmost lower support shelf having a vertical, forwardly facing front edge spaced rearwardly from the rear edge of the abutment defining the rearward wall of the first locking slot.

12. The invention of claim 11 wherein the abutment includes an upper surface sloping downwardly and rearwardly from its front to the rear edge.

13. The invention defined in claim 11 wherein at least the rearwardmost access opening in the main web is formed with an upwardly facing, downwardly and rearwardly inclined guide shelf merging at its rearward end with the forward end of the lower support shelf.

* * * * *